US005313774A

United States Patent [19]

Matsumoto et al.

[11] Patent Number: 5,313,774

[45] Date of Patent: May 24, 1994

[54] BLENDED SYNTHETIC SHORT FIBER YARN FABRIC

[75] Inventors: Mitsuo Matsumoto, Ibaraki; Nobuo Takahashi, Ikoma; Yoshiyuki Sasaki, Takatsuki, all of Japan

[73] Assignee: Teijin Limited, Osaka, Japan

[21] Appl. No.: 919,627

[22] Filed: Jul. 23, 1992

Related U.S. Application Data

[63] Continuation of Ser. No. 523,035, May 14, 1990, abandoned.

[30] Foreign Application Priority Data

May 24, 1989 [JP] Japan ..... 1-128624

[51] Int. Cl.[5] ..... D02G 3/22; D02G 3/38

[52] U.S. Cl. ..... 57/255; 57/252

[58] Field of Search ..... 57/255, 252, 210, 224, 57/231

[56] References Cited

U.S. PATENT DOCUMENTS

| | | | |
|---|---|---|---|
| 3,874,155 | 4/1975 | Knopka | 57/255 |
| 4,122,658 | 10/1978 | Morioka et al. | 57/245 |
| 4,226,079 | 10/1980 | Mountney et al. | 57/288 |
| 4,263,777 | 4/1981 | Wada et al. | 57/255 X |
| 4,457,345 | 7/1984 | von Blucher et al. | 57/252 X |
| 4,712,366 | 12/1987 | Tsujimoto et al. | 57/255 X |

FOREIGN PATENT DOCUMENTS

| | | | |
|---|---|---|---|
| 0079488 | 10/1982 | European Pat. Off. . | |
| 3307449 | 3/1983 | Fed. Rep. of Germany . | |
| 1367754 | 6/1963 | France . | |
| 7205532 | 12/1982 | Japan | 57/255 |
| 914704 | 4/1959 | United Kingdom | 57/255 |
| 1381937 | 6/1972 | United Kingdom . | |

*Primary Examiner*—Daniel P. Stodola
*Assistant Examiner*—John Rollins
*Attorney, Agent, or Firm*—Burgess, Ryan & Wayne

[57] ABSTRACT

A blended staple fiber yarn having a high grade cotton yarn-like touch, hand and appearance and superior mechanical strength, abrasion resistance, flame resistance and scratching resistance is comprised of 30 to 80 parts by weight of extremely fine polyester staple fibers having a denier of 0.9 or less and 20 to 70 parts by weight of super high modulus staple fibers having a Young's modulus of 4000 kg/mm$^2$ or more, and can be produced by a specific draft zone system spinning process in which individual filaments are drawn-cut and the resultant staple fibers are cohered to each other to form a spun yarn.

2 Claims, 4 Drawing Sheets

BLENDED SYNTHETIC SHORT FIBER YARN FABRIC

This application is a continuation of application Ser. No. 523,035, filed May 14, 1990, now abandoned.

BACKGROUND OF THE INVENTION

1. Field of the Invention

The present invention relates to a blended synthetic staple fiber yarn having a high grade cotton yarn-like touch, and a process for producing same.

2. Description of the Related Arts

Recent trends in public taste are toward the natural touch, hand and appearance of natural fiber articles, and accordingly, various attempts have been made to provide synthetic fiber articles having such a natural fiber article-like touch, hand, and appearance. Some of these attempts to provide synthetic fiber articles having a silk-like, wool-like or linen or ramie-like touch, hand, and appearance were successful, and a number of commercial articles having the above-mentioned natural fiber-like properties are in practical us.

Nevertheless, satisfactory results have not been obtained from attempts to provide synthetic fiber articles having a high grade cotton yarn-like touch, hand and appearance, and therefore, the development of the above-mentioned synthetic fiber articles is now underway.

SUMMARY OF THE INVENTION

An object of the present invention is to provide a blended synthetic staple fiber yarn having a high grade cotton yarn-like touch, for example, a sea island cotton yarn-like touch, hand and appearance not obtainable from the prior arts.

The above-mentioned object can be attained by the blended synthetic staple fiber yarn of the present invention, which comprises a blend of at least one type of extremely fine polyester staple fibers having a thickness of 0.9 denier or less and at least one type of super high modulus staple fibers having a Young's modulus of 4000 kg/mm$^2$ or more, in a blend ratio of from 30:70 to 80:20 by weight.

The above-mentioned specific blended synthetic staple fiber yarn can be produced by the process of the present invention, which comprises the steps of: doubling at least one type of extremely fine polyester multifilament yarn composed of individual filaments having a thickness of 0.9 denier or less with at least one type of super high modulus multifilament yarn composed of a plurality of individual filaments having a Young's modulus of 4000 kg/mm$^2$ or more in a blend ratio of from 30:70 to 80:20 by weight, to provide a blended multifilament tow;

subjecting the blended multifilament tow to a draft zone system spinning process in which the individual filaments in the blended multifilament tow are drawn-cut between a pair of feed nip rollers and a pair of draw-cutting nip rollers, and the resultant staple fibers are blended with each other to provide a blended staple fiber bundle; and passing the blended staple fiber bundle through an air nozzle device to cohere the individual staple fibers in the bundle to each other and to provide a blended staple fiber yarn.

DESCRIPTION OF THE PREFERRED EMBODIMENTS

During research into various blended synthetic staple fiber yarns, it was found for the first time by the inventors of the present invention that, when a plurality of individual polyester staple fibers having an extremely small denier are blended with a plurality of individual staple fibers having a super high Young's modulus, the resultant staple fiber blend surprisingly results in a blended staple fiber yarn having a high grade cotton yarn-like touch, hand and appearance not obtainable from the prior art.

The blended synthetic staple fiber yarn of the present invention comprises a blend of at least one type of extremely fine polyester staple fibers having a thickness of 0.9 denier (1.0 d tex) or less and at least one type of staple fibers having a super high Young's modulus of 4000 kg/mm$^2$, in a blend ratio of from 30:70 to 80:20 by weight.

Popular synthetic short fibers usually have a Young's modulus of from 100 to 800 kg/mm$^2$, and compared with those fibers, the super high modulus synthetic fibers have a very high Young's modulus of 400 to 15,000 kg/mm$^2$, a poor elongation, and a low weight or specific gravity. Therefore, the super high modulus fibers are usable for various industrial materials, for example, aircraft, high pressure containers, reinforcing materials for cement, abrasion-resistant materials, packing (gasket) materials, belts, cables, tires, and hoses.

Also, the polyester staple fibers usable for the present invention have an extremely small denier of 0.9 (1.0 d tex) or less, for example, from 0.08 to 0.9 (about 0.09 to 1.0 d tex), whereas the popular synthetic fibers have a denier of 5 to 1.2.

The extremely fine polyester staple fibers have a unique and novel touch and hand, and an attractive appearance, for example, a very soft touch and hand and a fine grandrelle yarn-like appearance, and therefore, are useful for high grade clothes, for example, silky woven fabrics, suede-like artificial fabrics, peach skin-like woven fabrics, and downy skin-like fabrics.

Surprisingly, it was found that, when the above-mentioned two types of synthetic staple fibers, which have extremely different properties, are blended together and the blend is spun, the resultant blended staple fiber yarn exhibits a unique high grade cotton yarn-like touch, hand and appearance not to be expected from two such different types of staple fiber yarns. The reasons for this effect are not absolutely clear at the present stage, but it is assumed that the high rigidity and low elongation of the super high modulus fibers and the high softness or flexibility of the extremely fine fibers cooperate to create a unique resiliency and a high soft touch similar to those of a high grade cotton yarn, for example, a sea island cotton yarn, on the resultant blended staple fiber yarn.

Figure 1A:
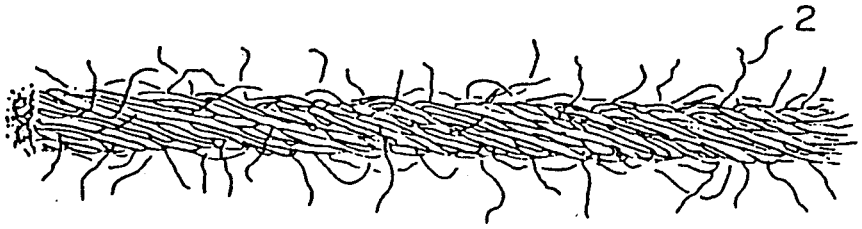
Fig. 1A (PRIOR ART)
FIG. 1A is a side view of a cotton spun yarn of the prior art.
Figure 1B:
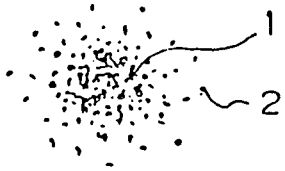
Fig. 1B (PRIOR ART)
FIG. 1B is a cross-sectional view of the cotton spun yarn shown in FIG. 1A.

The individual high grade cotton fibers, for example, the individual sea island cotton fibers are characterized by a very small thickness of 0.7 to 1.0 denier, a relatively high Young's modulus of 1000 to 1300 kg/mm2, and a relatively low ultimate elongation of 3 to 7%, and when the cotton fibers are formed to a fiber bundle while twisting, the resultant spun yarn has a side view as shown in FIG. 1A and a cross-sectional distribution of the staple fibers as indicated in FIG. 1B.

In the spun cotton yarn as shown in FIGS. 1A and 1B, a core portion 1 of the spun yarn serves to create a high resiliency and the fluffs 2 located around the core portion serve to produce a high softness on the cotton spun yarn. Accordingly, it is assumed that the combination of the high resiliency and high softness generate the unique touch and hand of the high grade cotton yarn.

Nevertheless, when formed only from the extremely fine synthetic staple fibers, the resultant spun yarn exhibits only a high softness but does not have a satisfactory resiliency, and thus can be easily distinguished in touch and hand from the high grade cotton yarn.

Also, when produced from only the super high modulus synthetic staple fibers, the resultant spun yarn exhibits an excessively high resiliency and stiffness and an undesirably stiff touch or hand, which are quite different from those of the high grade cotton yarn.

In the blend for the blended synthetic staple fiber yarn of the present invention, the blend ratio of the extremely fine polyester staple fibers to the super high modulus short fibers must be in the range of from 30:70 to 80:20, preferably from 40:60 to 70:30, by weight. When the blend ratio is less than 30:70 by weight, the resultant blended staple fiber yarn has an excessively high resilience and a stiff touch or hand, due to the excessively high content of the super high modulus synthetic staple fibers, and often the extremely fine polyester short fibers and the super high modulus short fibers cannot be satisfactorily evenly blended.

Also, when the blend ratio is more than 80:20 by weight, the resultant blended staple fiber yarn exhibits an excessively poor resiliency and an excessively high soft touch or hand, due to the excessively high content of the extremely fine polyester staple fibers, and the two different types of staple fibers are often not evenly blended.

The contribution of the blend ratio to the blended staple fiber yarn is indicated in Table 1.

TABLE 1

| Blend ratio (by wt) | | Blended short fiber yarn (*)$_3$ | | |
|---|---|---|---|---|
| Extremely fine polyester short fiber (*)$_1$ | Super high modulus synthetic short fiber (*)$_2$ | Resilience and stiffness | Touch | Blending evenness |
| 0 | 100 | Excessively high | Excessively stiff | — |
| 10 | 90 | Excessively high | Excessively stiff | Uneven |
| 20 | 80 | Very high | Very stiff | Uneven |
| 30 | 70 | Slightly high | Slightly stiff | Slightly uneven |
| 40 | 60 | Good | Good | Good |
| 50 | 50 | Good | Good | Good |
| 60 | 40 | Good | Good | Good |
| 70 | 30 | Good | Slightly too soft | Good |
| 80 | 20 | Slightly low | Much too soft | Slightly uneven |
| 90 | 10 | Too low | Much too soft | Uneven |
| 100 | 0 | Much too low | Much too soft | — |

Note:
(*)$_1$Polyethylene terephthalate short fibers having a denier of 0.4 and an average length of 210 mm
(*)$_2$Para-type aramide staple fibers having a denier of 1.5 and an average length of 180 mm
(*)$_3$The resultant blended staple fiber yarn had a total denier of 130. The blended staple fiber yarn was woven to form a one-side matt structure and the fabric was subjected to an evaluation of resiliency, stiffness and touch of the blended yarn.

If extremely fine polyester staple fibers and super high modulus staple fibers having a different color and dyeing property from each other are unevenly blended, the resultant blended staple fiber yarn exhibits an uneven color and is unevenly dyed. The blending evenness depends on the blend ratio and the difference in the modulus of the two different types of staple fibers. Therefore, the blend ratio must be controlled in consideration of the difference in modulus of the two different types of staple fibers, to provide a uniformly blended staple fiber yarn.

Also, the resiliency, stiffness, touch and blending evenness of the two different types of staple fibers, and the uniformity of the thickness of the blended staple fiber yarn, are greatly influenced by the thickness (fineness, denier) of the extremely fine polyester staple fibers, as shown in Table 2.

TABLE 2

| Denier of individual polyester short fiber (*)$_4$ | Blended short fiber yarn (*)$_5$ | | | |
|---|---|---|---|---|
| | Resiliency and stiffness | Touch | Blending evenness | Yarn thickness uniformity |
| 0.09 | Slightly low | Very soft | Good | Good |
| 0.3 | Good | Good | Good | Good |
| 0.6 | Good | Good | Good | Good |
| 0.9 | Slightly high | Slightly stiff | Good | Good |
| 1.2 | High | Stiff | Slightly poor | Very slightly poor |
| 1.5 | Excessively high | Very stiff | Poor | Slightly poor |

Note:
(*)$_4$Polyethylene terephthalate short fibers having an average length of 210 mm
(*)$_5$In the blended short fiber yarn, the polyester short fibers were blended with para-type aramide short fibers having a denier of 1.5 and an average length of 180 mm, in a blend ratio of 55:45 by weight. The blended yarn was woven to form a one side matt structure, and the resultant fabric was subjected to the evaluation of the properties of the blended yarn.

Table 2 shows that, when the denier of the extremely fine polyester short fibers is more than 0.9, the resultant blended short fiber yarn exhibits an excessively stiff touch and cannot provide a high grade cotton yarn-like touch. Namely, the larger the denier of the extremely fine polyester short fibers, the higher the resiliency and stiffness of the resultant blended short fiber yarn, and further, the greater the difference in the touch of the resultant blended short fiber yarn from the touch of a high grade cotton yarn.

Also, since the increase in the denier of the extremely fine polyester short fibers results in decrease in the number of the extremely fine polyester short fibers contained in the resultant blended short fiber yarn, the evenness of the blending of the two different type of short fibers and the uniformity of the thickness of the resultant blended short fiber yarn are lowered, as clearly shown in Table 2.

The above-mentioned tendency becomes increased with a decrease in the blend ratio to less than 30:70 or an increase in the blend ratio to more than 80:20, or with a decrease in the thickness of the resultant blended staple fiber yarn from a denier of 200 to the denier of 140 or less usual in high grade cotton yarns.

Accordingly, the blend ratio of the extremely fine polyester staple fibers to the super high modulus short fibers should be in the range of from 30:70 to 80:20 by weight. Also, the thickness of the blended staple fiber yarn of the present invention is preferably 200 denier or less.

The extremely fine staple fibers usable for the present invention are selected from polyester staple fibers preferably comprising at least one member selected from polyethylene terephthalate, polybutylene terephthalate and polynaphthalene terephthalate, which have a satisfactory extremely fine fiber-forming property, spinning property, and draw-cutting property, an adequate level of modulus and surface frictional property and a high dyeability, which are necessary for obtaining a blended synthetic staple fiber yarn having a high grade cotton yarn-like touch, hand and appearance.

In view of the above-mentioned necessity, nylon fibers, acrylic fibers and the like are not suitable as the extremely fine fibers usable for the present invention.

The super high modulus short fibers usable for the present invention should have a Young's modulus of 4000 kg/mm$^2$ or more, and therefore, are not selected from other popular synthetic fibers having a Young's modulus of 100 to 800 kg/mm$^2$.

The super high modulus short fibers are preferably selected from para-type aromatic polyamide fibers high strength polyethylene fibers, glass fibers, carbon fibers, and steel fibers. In view of the flexural strength, specific gravity, extremely fine fiber-forming property, and heat resistance, the super high modulus fibers are preferably selected from organic synthetic super high modulus fibers, more preferably from the para-type aromatic polyamide fibers. The thickness of the super high modulus fibers is not critical and can be varied in accordance with the content thereof in the resultant blended yarn, but preferably is as small as possible, most preferably 1.0 denier or less.

As described above, the blended synthetic fiber yarn of the present invention comprises a blend of 30 to 80 parts by weight of at least one type of extremely fine polyester fibers having a denier of 0.9 or less with 70 to 20 parts by weight of at least one type of super high modulus staple fibers having a Young's modulus of 4000 kg/mm$^2$ or more. The method of blending and spinning the two different types of staple fibers can be selected from conventional blending and spinning methods.

Namely, the blended synthetic staple fiber yarn of the present invention can be produced by a usual spinning process comprising the steps of sclutching, carding drawing, roving and fine spinning, or a tow spinning method comprising the steps of draw-cutting, gilling, roving and fine spinning. The resultant blended staple fiber yarn is a twisted yarn as shown, for example, in FIGS. 2A and 2B.

Figure 2A:
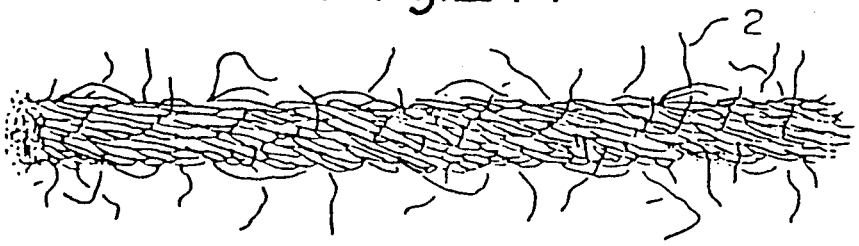
FIG. 2A is a side view of a blended staple fiber yarn of the present invention produced by a usual spinning process or a tow spinning process and having a high grade cotton yarn like touch.
Figure 2B:
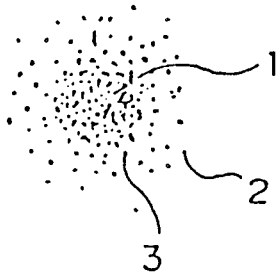
FIG. 2B is a cross-sectional view of the blended staple fiber yarn shown in FIG. 2A.

In FIGS. 2A and 2B, a core portion 1 of the yarn is mainly composed of the super high modulus staple fibers having a high modulus and a low elongation and the peripheral portion 3 and fluffs 2 of the yarn are mainly composed of the extremely fine polyester staple fibers.

Figure 3:
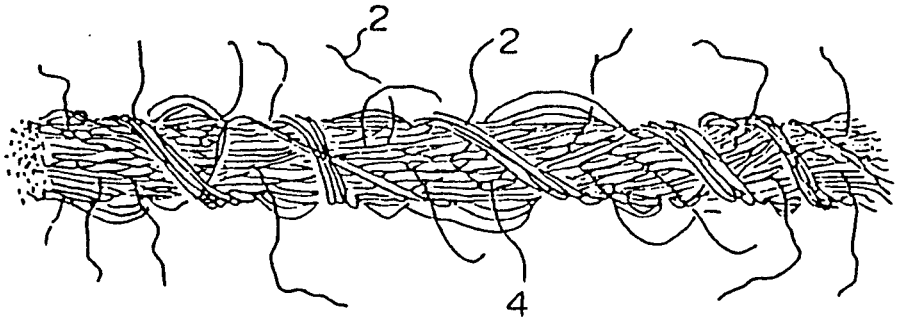
FIG. 3 is a side view of a blended, non-twisted staple fiber yarn of the present invention produced by a draw-cut direct spinning process.

The blended staple fiber yarn can be produced by the process of the present invention, in which at least one type of extremely fine polyester multifilament yarn composed of a plurality of individual filaments having a denier of 0.9 or less is doubled with at least one type of super high modulus multifilament yarn composed of a plurality of individual filaments having a Young's modulus of 4,000 kg/mm$^2$ or more, in a blend ratio of from 30:70 to 80:20 by weight; the resultant blended multifilament tow is subjected to a draft zone system spinning process in which the individual filaments in the tow are drawn cut between a pair of feed nip rollers and a pair of draw-cutting rollers and the resultant staple fibers are blended with each other; and the resultant blended staple fiber bundle is passed through an air nozzle device in which the staple fibers are interlaced with each other and the fluffs are wound around the staple fiber bundle, to provide a non-twisted yarn, as shown in FIG. 3.

In FIG. 3, the individual staple fibers are interlaced with each other without twisting and some of the fluffs 2 are wound around the staple fiber bundles 4.

Figure 4:
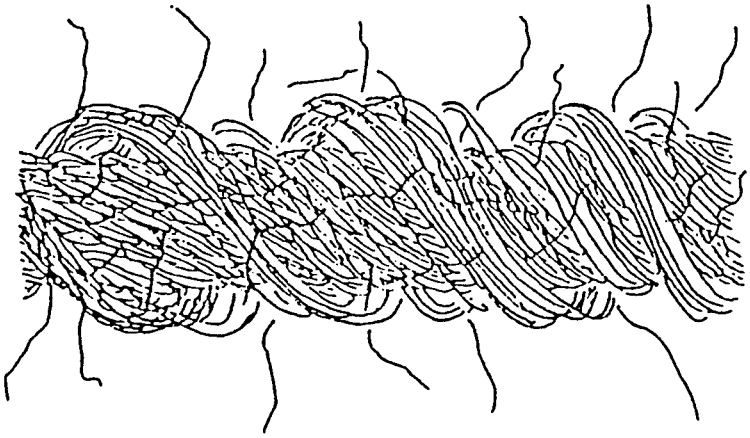
FIG. 4 is a side view of a blended staple fiber hard twist yarn of the present invention.

When the twisted or non-twisted yarn produced in the above-mentioned methods is further twisted, the super high modulus short fibers, which have a very poor stretching property, causes the yarn to be twist-shrunk and to be locally compressed, and therefore, the extremely fine polyester staple fibers having a higher stretching property than that of the super high modulus staple fibers are moved to the peripheral portions of the yarn. Accordingly, in the resultant twisted yarn shown in FIG. 4, the core portion of the yarn is mainly composed of the super high modulus staple fibers and the peripheral portion of the yarn is mainly composed of the extremely fine polyester staple fibers, and thus the resultant blended short fiber yarn of the present invention exhibits a high grade cotton yarn-like touch, hand and appearance.

Figure 5:
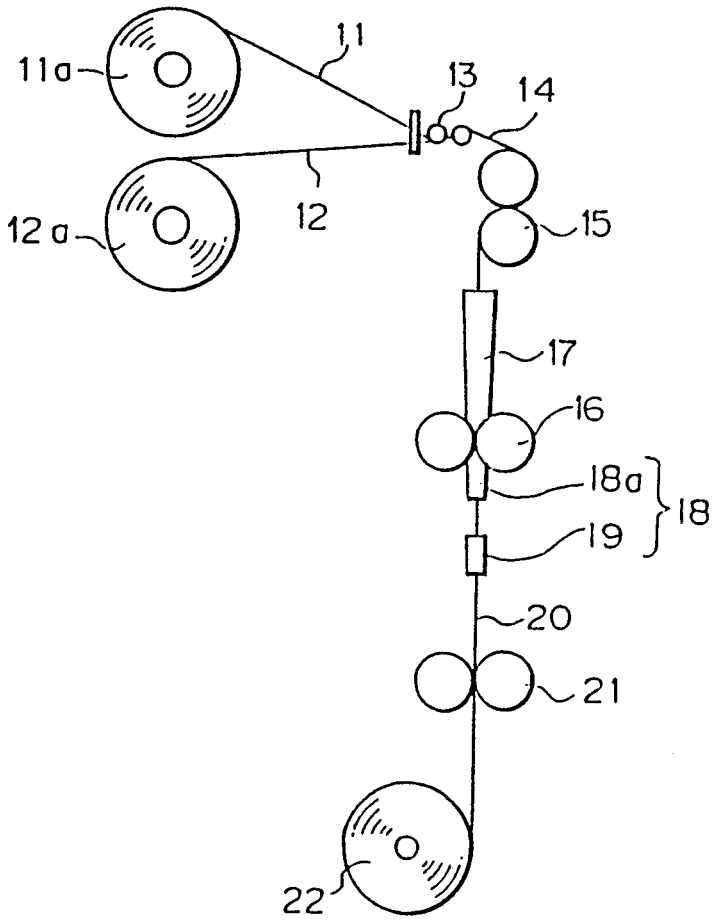
FIG. 5 shows a draw-cut direct spinning apparatus usable for carrying out the process of the present invention; and, FIG. 6 shows a tow spinning apparatus usable for producing the blended staple fiber yarn of the present invention.

The process of the present invention can be carried out by using the draft zone system spinning apparatus as shown in FIG. 5.

An example of the process of the present invention will be described below.

Referring to FIG. 5, an extremely fine polyester multifilament yarn 11 having a yarn count of 1296 deniers/2880 filaments and a denier of individual filaments of 0.45 was withdrawn from a bobbin 11*a* and doubled with a super high modulus papa-type aromatic polyamide multifilament yarn having a yarn count of 1000 deniers/1000 filaments. In this yarn, the individual filaments had a Young's modulus of 7100 kg/mm$^2$ and a denier of 1, and it was taken from the bobbin 12a, through doubling rollers 13. The resultant doubled multifilament tow 14 was drawn-cut between a pair of feed nip rollers 15 and a pair of draw-cutting nip rollers 16, through a shooter 17, at a draw cutting ratio of 17.5, to blend the two types of staple fibers with each other. The resultant blended staple fiber bundle was passed through an air nozzle device 18 composed of a sucking nozzle 18a and a cohering nozzle 19, to cause the two types of staple fibers to cohere to each other.

The resultant blended staple fiber yarn 20 was delivered from the air nozzle device 18 through a pair of delivery rollers 21, and wound around a bobbin 22.

In the resultant blended staple fiber yarn, the extremely fine polyester short fibers had a decreased denier of 0.4 and the blend ratio of the extremely fine polyester staple fibers to the super high modulus short fibers was 56:44. Also, the blended staple fiber yarn had a total denier of 133.

In the above-mentioned draft zone system spinning process, when the draft ratio between the draw-cutting rollers 16 and the delivery rollers 21 is controlled to a level of 100:102 to 10:96, preferably from 100:100 to 100:98, and the intensity of the relaxing of the staple fibers moving through the air nozzle device 18 is lowered, the short fibers are arranged at a high degree of orientation without becoming tangled, and the resultant blended staple fiber yarn exhibits not only a high grade cotton yarn-like touch, hand and appearance but also a very high mechanical strength of about 3 to 6 times that of the usual cotton yarns. This specific effect of the present invention is enhanced with an increase in the average length of the staple fibers in the blended yarn. Note, this can be applied to the blended staple fiber yarn produced not only by the process of the present invention but also by the usual spinning process or the tow spinning process. Namely, when the average length of the staple fibers is 70 mm or more, the resultant blended staple fiber yarn exhibits the above-mentioned preferable properties.

When the blended staple fiber yarn described in the above-mentioned example was twisted at a twist number of 600 turns/m, and the twisted yarn was converted to a one side matt woven fabric having a warp density of 124 yarns/25.4 mm, a weft density of 84 yarns/25.4 mm, and a basis weight of 138 g/m$^2$. The resultant blended staple fiber yarn woven fabric had a satisfactory resilience, stiffness and soft touch, comparable to those of the high grade cotton yarn woven fabric.

Also, because the core portion of the blended staple fiber yarn was mainly composed of the super high modulus staple fibers, for example, the para-type aromatic polyamide staple fibers, the resultant woven fabric had the enhanced mechanical properties as shown in FIG. 3.

As shown in FIG. 3, the various properties of the blended staple fiber yarn of the present invention and of the woven fabric made therefrom are compared with those of a cotton yarn and a woven fabric made therefrom.

TABLE 3

| | Material | | | |
|---|---|---|---|---|
| | Cotton yarn and woven fabric therefrom | | Blended short fiber yarn and woven fabric therefrom | |
| Item | Warp | Weft | Warp | Weft |
| Yarn | | | | |
| Material | Cotton 100% | Cotton 100% | P(*)$_6$: 56% A(*)$_7$: 44% | P: 56% A: 44% |
| Tensile strength (g/d) | 2.1 | 2.0 | 8.2 | 8.2 |
| Ultimate elongation (%) | 9.1 | 5.0 | 5.0 | 5.0 |
| Shrinkage in boiling water (%) | 0.6 | 0.6 | 6.1 | 6.1 |
| Weaving structure | | | | |
| Yarn count | 50/2 | 40/1 | 40/1 | 40/1 |
| Density (yarn/25.4 mm) | 198 | 124 | 124 | 84 |
| Thickness (mm) | 0.29 | | 0.26 | |
| Basis weight (g/m$^2$) | 180 | | 138 | |
| Finish | Calendering and water-repellent treatment | | Calendering and water-repellent treatment | |
| Fabric | | | | |
| Tensile strength (kg/3 cm) | 62 | 24 | 116 | 41 |
| Ultimate elongation (%) | 14 | 8 | 14 | 11 |
| Tear strength (kg) | 1.7 | 0.9 | 10.6 | 5.3 |
| Seam strength (*)$_8$ (kg) | 38 | 53 | >67 | 62 |
| Scratch resistance (*)$_9$ (g) | 129 | | 155 | |
| Abrasion resistance at crease (times) | 175 | 108 | 292 | 183 |
| Abrasion resistance determined by JIS L1018 (times) | 37 | | 129 | |
| Resistance to frictional melting (*)$_6$ (rpm) | >1050 | | >1050 | |
| Palling resistance (ICI) (class) | 4 | 4 | 4 | 4 |
| Flame perforation resistance (*)$_7$ (sec) | Several seconds | | >5 min | |
| Flame resistance (Mecemamine method) (cm) | Burned | | 1.8 (not burnt) | |

In Table 3, the resistance (*)$_6$ to frictional melting was determined by pressing a specimen onto a disc while the disc was revolving, and the number of revolutions of the disc at which the specimen was frictionally melted so as to form a perforation in the specimen was counted. In this test, the surface of the disc was formed by a kraft paper sheet, and an area of the specimen of 0.6 cm$^2$ was pressed onto the disc at a point 60 mm from the revolving center of the disc, at a pressure of 7 kg.

The resistance $(*)_7$ to frame perforation was determined by positioning a specimen fixed to a frame horizontally, bringing a flame into contact with the lower face of the horizontal specimen at a flame temperature of about 780° C., and measuring the time (sec) required to form a perforation in the specimen.

The seam strength $(*)_8$ was determined by sewing two rectangular specimens each having long sides of 10 cm and short sides of 5 cm together at the short sides thereof, by a sewing machine, holding the joined piece at the free short sides thereof and drawing same in the longitudinal direction thereof by a tensile test machine, and measuring the load required to break the sewn seam. In the seam formation, a #14 sewing needle was used, the seam pitch was 16 stitches/3 cm, and the seam margin was 3 mm.

The resistance $(*)_9$ to scratching was determined by fixing a specimen to a circular metal frame having a diameter of 45 mm, causing an edge of a matt cutter (available from Olfer Co.) having an angle of 45 degrees to penetrate the specimen, and measuring the force required to push the cutter through the specimen.

In view of Table 3, it is clear that not only the mechanical strength such as the tensile strength, tear strength, and seam strength but also the abrasion resistances, for example, the abrasion resistance at creases, and abrasion resistance measured in accordance with Japanese Industrial Standard (JIS) L 1018-1077, 6.17 "Abrasion Resistance", Methods A by using a uniform abrasion tester, heat, and flame resistances, for example, flame perforation resistance and Mecemamine method flame resistance, and the resistance to scratching with an edge, of the woven fabric made of the blended staple fiber yarn of the present invention are superior to those of the high grade cotton yarn fabric. Especially, in the flame perforation test and the Mecemamine method flame test, even when the flame was brought into direct contact with the specimen surface, surprisingly the specimen was merely scorched and was not burnt into flame or was not perforated, despite the large content of the combustible extremely fine polyester staple fibers of 56% by weight in the blended staple fiber yarn fabric.

Accordingly, it is clear that the blended synthetic staple fiber yarn of the present invention has a high grade cotton yarn-like touch, hand and appearance, and superior mechanical strength, abrasion resistance, heat and flame resistance, and scratch resistance, in comparison with those of the high grade cotton yarn.

EXAMPLES

The present invention will be further explained by way of the following examples.

EXAMPLE 1

A blended staple fiber yarn was produced by using the draw-cut direct spinning apparatus shown in FIG. 5, from an extremely fine polyester multifilament yarn having a yarn count of 1296 denier/2880 filaments and composed of individual filaments having a denier of 0.45 (0.5 d tex) and a super high modulus multifilament yarn having a total denier of 1000 and composed of 667 para-type aromatic polyamide individual filaments having a denier of 1.5 and colored black with 5% by weight of carbon black.

Referring to FIG. 5, the polyester multifilament yarn 11 and the aromatic polyamide multifilament yarn 12 were taken up from the bobbins 11*a* and 12*a*, respectively, and doubled through a doubling device 13. The doubled multifilament tow 14 was drawn-cut between a pair of feed nip rollers 15 and a pair of draw-cut nip rollers 16, through a shooter 17, at a draw-cut ratio of 17.5 while evenly blending the cut fibers with each other, and the resultant thin blended staple fiber bundle was passed through an air nozzle device 18 composed of a sucking air nozzle 18*a* and a cohering air nozzle 19 in which the air flow was circulated, and individual staple fibers were cohered to each other by the action of the circulating air flow. The resultant blended staple fiber yarn 20 was delivered through a pair of delivery rollers 21 and wound around a bobbin 22. The peripheral speed ratio of the draw cut nip rollers 16 to the delivery rollers 21 was controlled to 100:99, to cause the staple fiber fluffs located in the peripheral portion of the yarn to be wound around the yarn at random. The resultant blended staple fiber yarn had a total denier of 133 and a blend ratio of the polyester short fibers to the aromatic polyamide staple fibers of 56:44. In the yarn, the polyester staple fibers had an average length of 32 cm and the aromatic polyamide staple fibers had an average length of 28 cm.

After twisting the blended staple fiber yarn at a twist number of 600 turns/m, the twisted yarn had a tensile strength of 8.2 g/denier, an ultimate elongation of 4.5%, and a shrinkage of 5.7% in boiling water.

The twisted blended staple fiber yarn was converted to a woven fabric having a 3/1 twill weaving structure, the resultant fabric was heat-set, the polyester staple fibers were dyed a gray color, and then the fabric was calender-finished. The resultant finished fabric had a warp density of 192 yarns/25.4 mm, a weft density of 143 yarns/25.4 cm, and a basis weight of 143 g/m$^2$, and exhibited a high grade cotton yarn fabric-like touch, hand and appearance.

The fabric had a tensile strength of 96 kg/3 cm in the warp direction and 78 kg/3 cm in the weft direction, a tear strength of 10.6 kg in the warp direction and 8.4 kg in the weft direction, a scratch strength of 200 g, an abrasion strength of 88 times measured by JIS L1018, and a satisfactory resistance to flame perforation and a Mecemamine method flame resistance.

EXAMPLE 2

Figure 6:
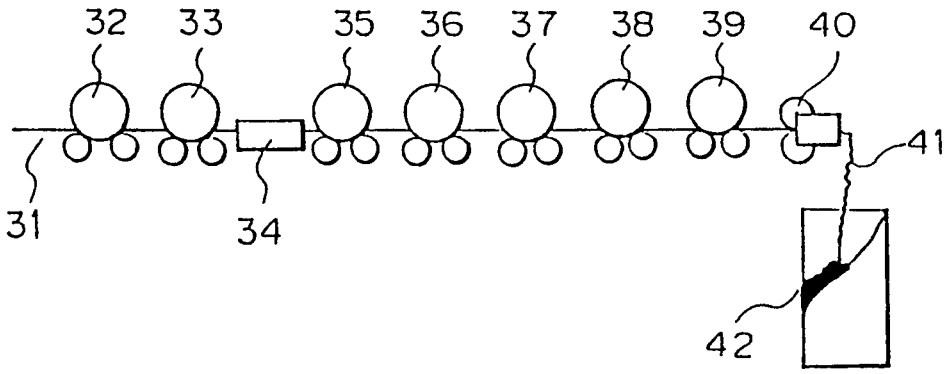

An extremely fine polyester fiber bundle having a total denier of 150,000 and composed of a multiplicity of individual filaments having a denier of 0.45 was drawn-cut in four steps at a total draft ratio of 8.8 by using the tow spinning apparatus shown in FIG. 6, to provide an extremely fine polyester staple fiber sliver (A) having a total denier of 17,000 and an average length of 100 mm.

Also, a para-type aromatic polyamide filament bundle having a total denier of 86,000 and composed of a multiplicity of individual filaments having a denier of 1.0 was drawn-cut by using the apparatus shown in FIG. 6, in four steps at a total draft ratio of 7.1, to provide an aromatic polyamide staple fiber sliver (B) having a total denier of 12,000, an average length of 89 mm, and a Young's modulus of individual short fibers of 7100 kg/mm$^2$.

As shown in FIG. 6, a filament bundle 31 was first drawn between a feed roller 32 and a preliminary drawing roller 33 and then heat set by a draw-heat setting heater 34. The heat-set filament bundle 31 was drawn cut in four steps, among the first, second, third, fourth and fifth draw-cutting rollers 35, 36, 37, 38 and 39. The resultant staple fiber sliver was crimped in a crimper 40, and the crimped staple fiber sliver delivered from the crimper 40 into a container 41.

The polyester staple fiber sliver A was doubled with the aromatic polyamide short fiber sliver (B) and the doubled sliver was successively treated by a gilling step, a roving step, and then a fine spinning step, to provide a blended short fiber single yarn having a blend ratio of the polyester staple fibers to the aromatic polyamide staple fibers of 59:41 and a yarn count of 50s/1.

The single yarn was converted to a two-folded yarn having a yarn count of 50s/2, and the two-folded yarn was used as warp and weft yarns and converted to a one side matt woven fabric having a warp density of 132 yarns/25.4 mm, a weft density of 107 yarns/25.4 mm, and a basis weight of 145 g/m$^2$.

The resultant woven fabric exhibited a high grade cotton yarn fabric-like touch, hand and appearance, and a greater bulkiness than that of the fabric of Example 1. Also, the woven fabric had a tensile strength of 121 kg/3 cm in the warp direction and 57 kg/3 cm in the weft direction, a tear strength of 14.0 kg in the warp direction and 4.8 kg in the weft direction, an abrasion resistance of 97 times measured by JIS L1018, and a satisfactory flame perforation resistance and Mecemamine method flame resistance.

When the extremely fine polyester filament bundle and the aromatic polyamide filament bundle were doubled together, the resultant doubled filament tow was drawn-cut by the apparatus of FIG. 6 and the resultant blended staple fiber sliver then subjected to the same spinning process as described above. The resultant blended staple fiber yarn and fabric exhibited properties similar to those mentioned above.

EXAMPLE 3

A staple fiber blend was prepared from 50 parts by weight of extremely fine polyester short fibers having a denier of 0.45 and a length of 77 mm and 50 parts by weight of para-type aromatic polyamide staple fibers having a denier of 1.5, a length of 77 mm, and a Young's modulus of 7100 kg/mm$^2$, in a scratching procedure. Then the blend was subjected successively to a usual carding procedure, drawing procedure, roving procedure and fine spinning procedure, to provide a blended staple fiber yarn having a single yarn count of 40s/1.

The single yarn was converted to a two-folded yarn having a yarn count of 40s/2, and the two folded yarn was used as a warp and weft and converted to a woven fabric having a two folded yarn tussah structure, a warp density of 119 yarns/25.4 mm, a weft density of 73 yarns/25.4 mm, and a basis weight of 172 g/m$^2$.

The resultant finished fabric exhibited a high grade cotton yarn fabric-like touch, hand and appearance, and had a tensile strength of 73 kg/3 cm in the warp direction and 46 kg/3 cm in the weft direction, a tear strength of 7 kg in the warp direction and 6.5 kg in the weft direction, an abrasion resistance of 88 times measured by JIS L1018, and a satisfactory flame perforation resistance and Mecemamine method flame resistance.

In general, since extremely fine polyester fibers having a small denier of about 0.5 or less have a poor absolute tensile strength, an excessively high flexibility, and an increased coefficient of friction, problems often arise in the carding and drawing procedures for the extremely fine polyester staple fibers, and thus the spinning property of the extremely fine polyester staple fibers is poor.

Nevertheless, when the extremely fine polyester staple fibers are blended with the super high modulus staple fibers, the blended short fibers exhibit an improved spinning property and can be converted to a spun yarn without difficulty.

Also, in general, when a usual spinning process is applied, the resultant blended staple fiber yarn often has a relatively low degree of orientation of the staple fibers, and thus a relatively high bulkiness and a slightly lower mechanical strength, in comparison with the blended staple fiber yarns produced by the draw cut-direct spinning process and by the tow spinning process.

As described above, the specific blended staple fiber yarn of the present invention exhibits a high grade cotton yarn-like touch, hand and appearance, and a superior mechanical strength, abrasion resistance, heat and flame resistance and scratch resistance, in comparison with those of the high grade cotton yarn.

Therefore, the blended staple fiber yarn of the present invention can be widely used for sport clothes and articles and for industrial materials.

We claim:

1. A blended synthetic staple fiber yarn fabric comprising blended synthetic staple fiber yarns having a high-grade cotton yarn-like touch and comprising a blend of a first group of extremely fine polyester staple fibers having a thickness of not more than 0.9 denier and a second group of super high modulus staple fibers comprising a para-type aromatic polyamide and having a thickness of not more than 1.0 denier and a Young's modulus of not less than 4000 kg/mm$^2$, said first fiber group and said second fiber group having an average length of at least 70 mm and being present in a blend ratio of said first fiber group to said second fiber group from 40:60 to 70:30 by weight.

2. The fabric as claimed in claim 1, wherein the blended synthetic fiber yarns have a total denier of not more than 200.

* * * * *